US009619992B2

(12) United States Patent
Addy

(10) Patent No.: US 9,619,992 B2
(45) Date of Patent: Apr. 11, 2017

(54) SELF-INSTALLED SECURITY SYSTEM

(75) Inventor: Kenneth L. Addy, Massapequa, NY (US)

(73) Assignee: HONEYWELL INTERNATIONAL INC., Morristown, NJ (US)

( * ) Notice: Subject to any disclaimer, the term of this patent is extended or adjusted under 35 U.S.C. 154(b) by 1242 days.

(21) Appl. No.: 13/181,586

(22) Filed: Jul. 13, 2011

(65) Prior Publication Data

US 2012/0124799 A1 May 24, 2012

Related U.S. Application Data

(60) Provisional application No. 61/416,457, filed on Nov. 23, 2010.

(51) Int. Cl.
*G08B 25/00* (2006.01)
*G08B 25/10* (2006.01)

(52) U.S. Cl.
CPC ..... *G08B 25/003* (2013.01); *G08B 25/10* (2013.01); *Y10T 29/4978* (2015.01); *Y10T 29/53039* (2015.01)

(58) Field of Classification Search
CPC .. G05D 23/1923; G08B 25/003; G08B 25/10; Y10T 29/53039; Y10T 29/4978
See application file for complete search history.

(56) References Cited

U.S. PATENT DOCUMENTS

| | | | | |
|---|---|---|---|---|
| 2004/0068478 | A1* | 4/2004 | Stubbs | G06F 17/30817 |
| 2007/0250695 | A1* | 10/2007 | Philyaw | G06F 9/4411 713/1 |
| 2009/0070436 | A1* | 3/2009 | Dawes et al. | 709/219 |
| 2011/0015802 | A1* | 1/2011 | Imes | 700/300 |
| 2011/0196755 | A1* | 8/2011 | Landa | 705/23 |

* cited by examiner

*Primary Examiner* — Sonji Johnson
(74) *Attorney, Agent, or Firm* — Husch Blackwell LLP

(57) ABSTRACT

A security system installation kit carries a coded designation of the characteristics of the components of the kit. An installer can use a wireless telephone, which is executing a scanning application, to sense or read the coded designation. The telephone can transmit the component parameters to an installation server. The server can transmit installation instructions back to the telephone. Those instructions can be visually or audibly presented to the installer facilitating the process. The installer, via the telephone and the server, can test the installed components for proper operation.

19 Claims, 2 Drawing Sheets

DIY SECURITY SYSTEM

DIY SECURITY SYSTEM

SELF-INSTALLED SECURITY SYSTEM

CROSS-REFERENCE TO RELATED APPLICATION

This application claims the benefit of the filing date of U.S. Provisional Application Ser. No. 61/416,457 filed Nov. 23, 2010 and entitled "Self-Installed Security System", which is hereby incorporated herein by reference.

FIELD

The application pertains to regional monitoring systems that provide audio and/or visual feedback to assist an individual in making an installation. More particularly, it pertains to such systems in which a cellular-type wireless telephone facilitates the process by providing audible or visual instructions to the individual.

BACKGROUND

Traditional security systems have been professionally installed and monitored. The installation process involves configuring wired and/or wireless security sensors that are installed in a building. Since all buildings are different, the installation process is difficult to standardize in a pre-configured kit so DIY (do-it-yourself) installation has been rarely used in the security industry.

Despite the above noted problems, there is a substantial do-it-yourself market that might respond to a product or kit that addresses the above issues.

DETAILED DESCRIPTION

Figure 1:
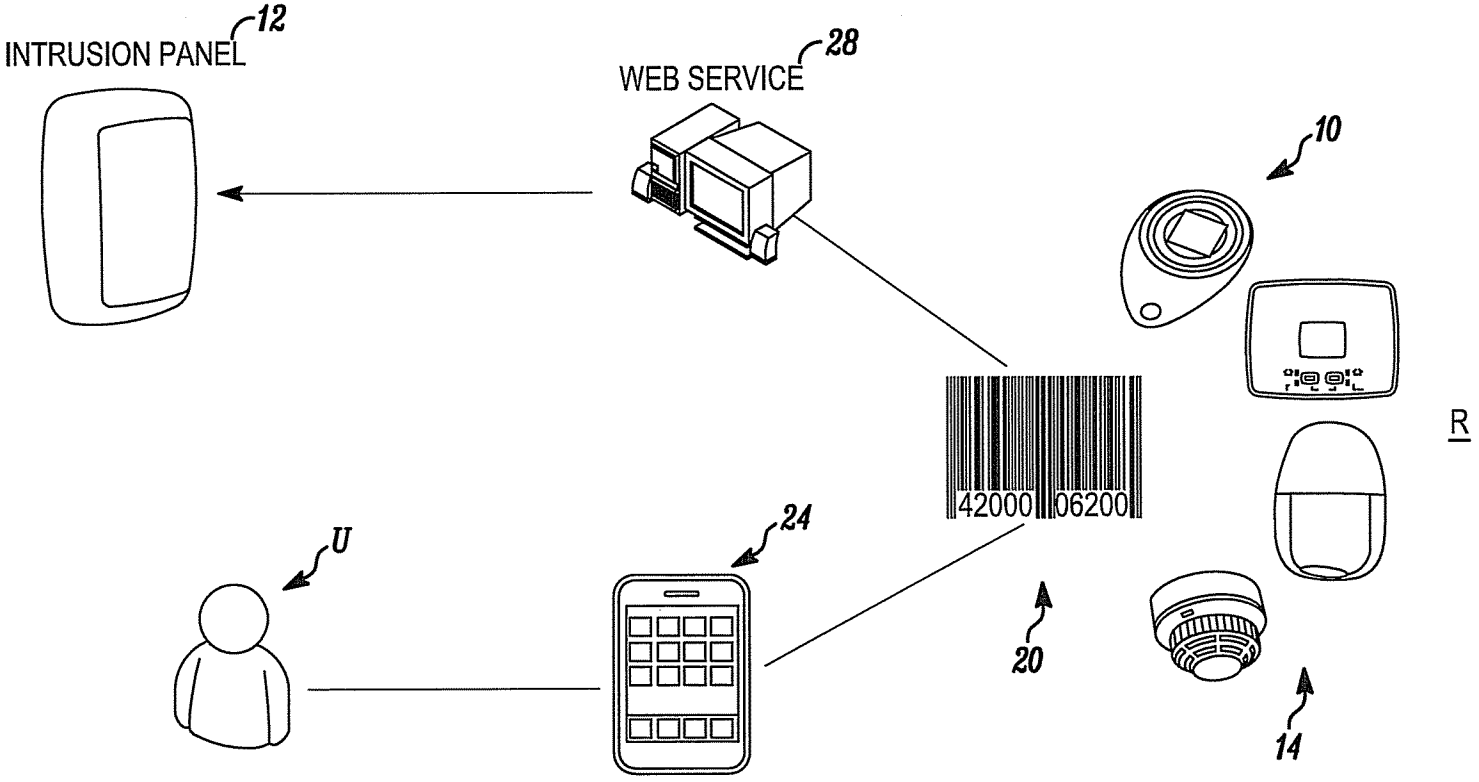
FIG. 1 is a block diagram illustrating aspects of a system in accordance herewith.

While disclosed embodiments can take many different forms, specific embodiments thereof are shown in the drawings and will be described herein in detail with the understanding that the present disclosure is to be considered as an exemplification of the principles thereof as well as the best mode of practicing the same and is not intended to limit the application or claims to the specific embodiment illustrated.

Embodiments of the current invention use the capability of a standard mobile phone camera in conjunction with bar-coded devices to enable DIY installation and configuration of a security system. The bar codes are used to download an application to lead a home owner through the installation process and subsequently to capture the bar code serial numbers and device types as the system components are installed. For example, a "QR code" (abbreviation for Quick Response code) is a specific matrix bar code (or two-dimensional code) that is readable by dedicated QR bar code readers and camera telephones. The code consists of black modules arranged in a square pattern on a white background. The information encoded may be text, URL, or other data.

The configuration is loaded to the control panel via the mobile phone's communication capability (cellular or Wi-Fi) into the security panel (POTS, Wi-Fi, or cellular). The application is designed to assist during the installation, to configure, and then to guide the user through a test routine to ensure that installation was completed properly.

For example, in accordance with an aspect of a method, a bar-coded element on a system carton downloads the installation application to a local communication device, such as a cellular phone. The application gives step-by-step instructions to guide a user through the process. Alternately, it would be possible to link to a website that gives instructions on installation, but does not download an application to the phone in order to enable end-to-end configuration and testing.

The control panel barcode is scanned—indicating capability and characteristics thereof. Then, as each detector or sensor element is installed, a device bar code is scanned. For example, when instructed to install the front door contact of a security system, the contact bar code is scanned, and the contact type and serial number are scanned into the phone.

If a device is not installed (e.g., no glass break detectors) then the user enters "no device". Following completion of the installation, the user uploads the configuration to the control panel, perhaps by Wi-Fi if the control panel is capable (determined during the first scan) or cellular communication. If connected via a cell phone, then the configuration could be downloaded directly to the panel, particularly for a self-monitoring system. If a central station is involved in the monitoring of the system, then the cellular communication would go via a redirection server so that the configuration information would go to the central station database as well as the local panel.

The application then places the panel into test mode, and the user is instructed to activate each sensor in a sequence that tests the quality of the installation.

If reporting of alarm events is to the mobile phone itself (for self-monitoring applications), then the event is returned to the phone through the entire end-to-end communication path. Reporting can also be to social networking or IM sites if required for self-monitoring.

For example, FIG. 1 illustrates a kit 10 that, when installed, can function as a monitoring system 10-1 to monitor conditions at a region R. A control panel 12 and a plurality of different detectors 14, such as motion detectors, smoke detectors, glass break detectors, door position detectors, or the like, all without limitation, can be shipped as the kit 10 with a 2D/3D bar code 20 printed on the outer carton thereof. A user or installer U scans the bar code 20 using a smart phone 24 that automatically connects to a web service 28 and guides the user U through the DIY installation process. The QR code on the outer carton or control panel itself could include the communication address and unique identifier for the system—e.g., a MAC ID or cellular communication module identifier.

The end user U is prompted to capture a bar code on each of the security devices or detectors 14 using a camera carried by the smart phone 24. All devices 14 have bar codes to identify the device type and a unique serial number. The user U then installs the devices, sensors, or detectors 14 in appropriate locations of a home or building to be monitored.

The configuration information for all detectors 14 is registered to the panel 12 from the smart phone 24 to the web service 28 and back to the panel 12 via wireless communication systems, such as Ethernet/GSM/GPRS. The system 10-1 is then ready to use in monitoring the region R. If the web service is local, e.g., in the control panel itself, then the communication could simply remain within the LAN, and communication would be over the local Wi-Fi network.

The devices 14 can be in wired or wireless communication with the control panel 12. Those of skill will understand that the control panel 12 provides monitoring functions to respond to inputs received from the detectors or devices 14 indicative of conditions in the monitored region R. The panel 12 can also be in wired or wireless communication with other monitoring units, including the server 28, all without limitation.

Figure 2:
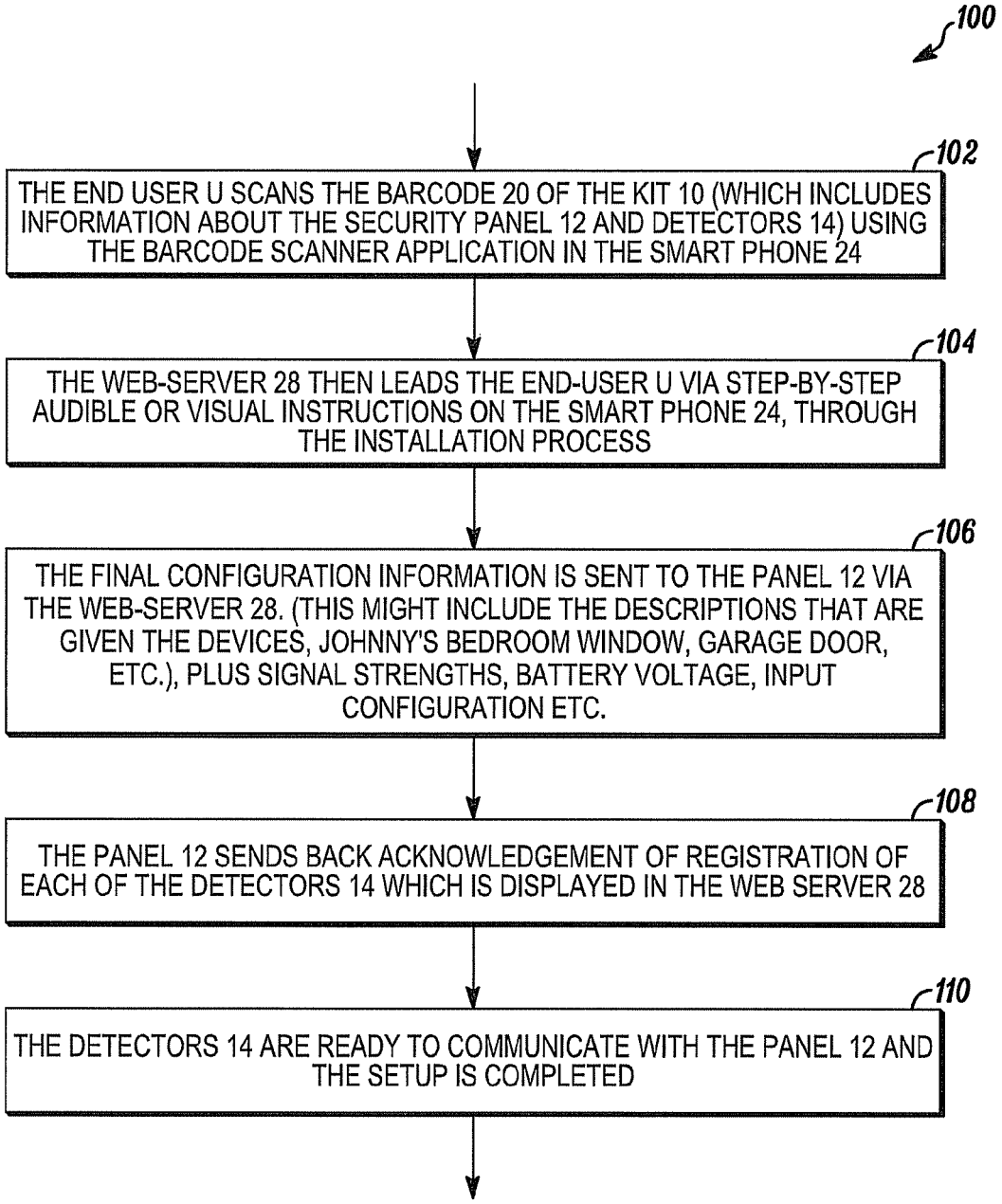
FIG. 2 is a flow diagram illustrating aspects of a method in accordance herewith.

FIG. 2 illustrates an installation process 100. Initially, as at 102, the user U scans the bar code 20 using the smart phone 24. The server 28 then leads the user U via step-by-step instructions presented by the phone 24, visually, audibly, or both, through the process of installing the detectors 14, as at 104.

Final configuration information can be sent to the panel 12, as at 106. The panel 12 can respond, as at 108. The installed detectors 14 and the control panel 12 can then interact, as at 110.

In summary, a kit based monitoring or intrusion detecting system can be installed by end users in easy steps supported by visual or verbal prompts or instructions based on the capability of a standard mobile phone camera combined with bar-coded devices. As a result, a DIY installation and configuration of a residential or commercial security system can be successfully and efficiently carried out with reduced costs since a professional installer is not required to install the system.

The bar codes are used to download an application to lead a home owner through the installation process and subsequently to capture the bar code serial numbers and device types as the system components are installed. The configuration is loaded to the control panel via the mobile phone's communication capability (cellular or Wi-Fi) into the security panel (POTS, Wi-Fi, or cellular). The application is designed to assist during the installation, to configure, and then to guide the user through a test routine to ensure that installation has been completed properly.

By way of further example, the screen on the phone can provide a menu of questions and instructions to help the end-user with the installation. There may or may not be audible indications. In this regard, after scanning the panel, the user would get an instruction to scan the bar code on the first device. For example, the phone would say, "You have scanned a glass break detector. This needs to be mounted within 10 feet of the glass that you are protecting and facing the glass". The phone could also say, "After you mount the device, please enter the description for the device", and the cursor would then allow entry of "front door glass". The screen would then prompt scanning of the second device by displaying "You have scanned a low temperature detector".

It will be also understood that other machine readable coding configurations apart from bar codes come within the spirit and scope hereof. Also, the type of portable communications unit, such as the unit 24, is not a limitation hereof.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims. Further, logic flows depicted in the figures do not require the particular order shown or sequential order to achieve desirable results. Other steps may be provided, steps may be eliminated from the described flows, and other components may be added to or removed from the described embodiments.

The invention claimed is:

1. An installation kit comprising:

a carton containing a condition detector and a control panel of a regional monitoring system;

a first coded element on the carton that specifies characteristics of the condition detector and the control panel, wherein step-by-step installation instructions for both the condition detector and the control panel are downloaded to a communications device in response to the communications device sensing the first coded element; and a second coded element on the condition detector that specifies a respective serial number and a respective device type, wherein the communications device senses the second coded element associated with the condition detector to capture the respective serial number and the respective device type as the condition detector is installed to generate a configuration file containing serial numbers and device types for all installed components, and wherein the configuration file is uploaded by the communications device to the control panel to initiate communication between the control panel and the condition detector.

2. The installation kit as in claim 1 further comprising circuitry that provides configuration information to the control panel.

3. The installation kit as in claim 1 further comprising circuitry to establish the communication between the condition detector and the control panel.

4. The installation kit as in claim 1 wherein the communications device comprises one of a cellular-type telephone, a personal digital assistant, a laptop computer, or a wireless pad computer.

5. The installation kit as in claim 1 wherein the communications device displays a process to test operation of the condition detector and the control panel.

6. The installation kit as in claim 1 further comprising a plurality of condition detectors, wherein the communications device emits the step-by-step installation instructions at least one of visually or audibly for installation of each of the plurality of condition detectors.

7. The installation kit as in claim 1 further comprising a plurality of condition detectors, wherein some of the plurality of condition detectors are different than others, and wherein the communications device emits different ones of the step-by-step installation instructions visually or audibly for different ones of the plurality of condition detectors.

8. The installation kit as in claim 7 wherein configuration information is transmitted to the control panel.

9. The installation kit as in claim 1 wherein the communications device outputs the step-by-step installation instructions visually or audibly.

10. A method of installing a regional monitoring system comprising:

sensing information prestored on a first coded element associated with an installation kit carton at a first location;

transmitting at least some of the information to a receiver;

responsive to the transmitting, receiving step-by step installation instructions for each of a plurality of devices in the installation kit carton from the receiver at the first location;

responsive to the receiving the step-by-step installation instructions, generating a sequence of installation instructions for each of the plurality of devices in the installation kit carton as at least one of an audio output or a visual output;

responsive to the sequence of installation instructions, sensing at least one of a plurality of second coded elements associated with respective ones of the plurality of devices in the installation kit carton, wherein each of the plurality of second coded elements specifies a respective serial number and a respective device type for a respective one of the plurality of devices in the installation kit carton;

generating a configuration file containing serial numbers and device types for each of the plurality of devices based on the sensing of the at least one of the plurality of second coded elements; and uploading the configuration file to a control panel of the regional monitoring system to initiate communication between the control panel and each of the plurality of devices.

11. The method as in claim 10 further comprising providing installed system configuration data to a control unit.

12. The method as in claim 11 further comprising providing a wireless communications device, wherein the sensing is carried out via the wireless communications device.

13. The method as in claim 12 wherein the sensing comprises Bar code scanning that is carried out by executing a bar code scanning application running on the wireless communications device.

14. The method as in claim 12 wherein the transmitting is carried out wirelessly by the wireless communications device.

15. The method as in claim 12 wherein the generating is carried out by the wireless communications device.

16. An installation kit comprising:

an assemblage including an assemblage carton containing a regional monitoring control panel and a plurality of coded peripheral environmental sensing units; and a multi-dimensional coded element carried by the assemblage carton, wherein each of the plurality of coded peripheral environmental sensing units includes a communications interface with the communications interface of each of the plurality of coded peripheral environmental sensing units having a wired or wireless output port compatible with a communications interface of the regional monitoring control panel, wherein the regional monitoring control panel includes an input/output port for communication via a computer network, wherein each member of the assemblage carries a coded representation indicative of characteristics of a respective member of the assemblage, wherein a communications device senses the coded representation associated with each member of the assemblage as each member of the assemblage is installed to capture the characteristics of the respective member of the assemblage and to generate a configuration file containing the characteristics of the respective member of the assemblage, and wherein the configuration file is uploaded by the communications device to the regional monitoring control panel to initiate communication between the regional monitoring control panel and each of the plurality of coded peripheral environmental sensing units, and wherein the multi-dimensional coded element is sensed and transmitted to an installation support service for retrieval of step-by-step installation instructions for each member of the assemblage.

17. The installation kit as in claim 16 further comprising circuitry to sense the multi-dimensional coded element and to present the step-by-step installation instructions visually or audibly for installing the plurality of coded peripheral environmental sensing units in a selected region.

18. The installation kit as in claim 17 wherein the regional monitoring control panel includes circuitry to wirelessly receive and store information associated with the coded representation of each member of the assemblage.

19. The installation kit as in claim 18 wherein the regional monitoring control panel includes circuitry to test operation of each member of the assemblage for which the information associated with the coded representation of the respective member of the assemblage has been received.

* * * * *